US011641085B2

(12) United States Patent
Penn et al.

(10) Patent No.: US 11,641,085 B2
(45) Date of Patent: May 2, 2023

(54) ELECTRICAL CONNECTOR ASSEMBLY AND METHOD FOR MANUFACTURING SAME

(71) Applicant: Aptiv Technologies Limited, St. Michael (BB)

(72) Inventors: Matthew L. Penn, Cortand, OH (US); Steven P. Ragalyi, Cortland, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 47 days.

(21) Appl. No.: 17/407,729

(22) Filed: Aug. 20, 2021

(65) Prior Publication Data

US 2022/0115828 A1 Apr. 14, 2022

Related U.S. Application Data

(60) Provisional application No. 63/091,373, filed on Oct. 14, 2020.

(51) Int. Cl.

| | |
|---|---|
| ***H01R 43/18*** | (2006.01) |
| ***H01R 24/40*** | (2011.01) |
| ***H01R 103/00*** | (2006.01) |

(52) U.S. Cl.

CPC ..... *H01R 43/18* (2013.01); *H01R 24/40* (2013.01); *H01R 2103/00* (2013.01)

(58) Field of Classification Search

CPC ..... H01R 4/02; H01R 4/029; H01R 12/707; H01R 13/504; H01R 13/5045; H01R 24/40; H01R 43/18; H01R 2103/00

See application file for complete search history.

(56) References Cited

U.S. PATENT DOCUMENTS

| | | | | |
|---|---|---|---|---|
| 8,182,285 | B2 | 5/2012 | Annequin et al. | |
| 9,926,509 | B2 | 3/2018 | Schilowitz et al. | |
| 9,960,550 | B2 | 5/2018 | Ensley et al. | |
| 10,096,927 | B2 | 10/2018 | Hashiguchi | |
| 10,177,503 | B2 | 1/2019 | Zou | |
| 11,515,679 | B2 * | 11/2022 | Lashinsky | H05K 5/0052 |

(Continued)

OTHER PUBLICATIONS

Extended European Search Report for EP Application No. 21200043.4, dated Mar. 4, 2022, 12 pages.

*Primary Examiner* — Oscar C Jimenez
(74) *Attorney, Agent, or Firm* — Billion & Armitage

(57) ABSTRACT

An electrical connector assembly includes an electrical terminal having a connection portion and an attachment portion angled relative to the connection portion. The assembly also includes a cylindrical inner housing sleeve formed of a polymeric material in which the connection portion of the electrical terminal is disposed and an outer connector housing formed of a polymeric material having a smooth bore configured to receive the inner housing sleeve containing the electrical terminal. The bore and inner housing sleeve are sized such that the inner housing sleeve is in an interference fit condition when received within the bore. The electrical connector assembly is assembled by a process having the steps of inserting the inner housing sleeve within the bore of the outer connector housing and affixing the inner housing sleeve to the outer connector housing by welding the inner housing sleeve to the outer connector housing.

18 Claims, 6 Drawing Sheets

(56) References Cited

U.S. PATENT DOCUMENTS

| | | | | |
|---|---|---|---|---|
| 2002/0177358 | A1* | 11/2002 | Baffert | H01R 9/0518 439/582 |
| 2018/0026408 | A1 | 1/2018 | Ensley et al. | |
| 2019/0081431 | A1* | 3/2019 | Heyman | H01R 31/065 |
| 2019/0326706 | A1* | 10/2019 | Penn | H01R 43/26 |
| 2019/0372263 | A1* | 12/2019 | Dvorak | H01R 13/504 |
| 2021/0127505 | A1* | 4/2021 | Lu | H05K 5/0013 |
| 2021/0408743 | A1* | 12/2021 | Lashinsky | H05K 7/1417 |
| 2022/0250548 | A1* | 8/2022 | Karrasch | B60R 1/20 |

* cited by examiner

ELECTRICAL CONNECTOR ASSEMBLY AND METHOD FOR MANUFACTURING SAME

CROSS REFERENCE TO RELATED APPLICATIONS

This application claims the benefit of priority to U.S. Provisional Patent Application No. 63/091,373 filed on Oct. 14, 2020, the entire disclosure of which is hereby incorporated by reference.

BACKGROUND

Right angled electrical connectors used to terminate wire electrical cables have terminals with a connection end that is designed to interconnect with a corresponding mating terminal and an attachment end attached to the wire cable that is arranged at a right angle to the connection end. In some applications, it is desirable to have the wire cable in a particular orientation relative to a connector housing holding the terminal. In prior connector designs, the terminal and housing were designed so that the cable was in one fixed orientation, e.g. 6 o'clock position, or in one of four orientations, e.g. 12 o'clock, 3 o'clock, 6 o'clock, or 9 o'clock. Changing these fixed orientations requires an investment of time and money to develop new connector tooling to manufacture a connector with a different cable orientation.

SUMMARY

According to one or more aspects of the present disclosure, an electrical connector assembly includes an electrical terminal having a connection portion configured to interface with a corresponding mating electrical connector and an attachment portion configured to interface with an electrical cable. The connection portion is angled relative to the attachment portion. The electrical connector assembly also includes a cylindrical inner housing sleeve formed of a polymeric material in which the connection portion of the electrical terminal is disposed and an outer connector housing formed of a polymeric material having a smooth bore configured to receive the inner housing sleeve containing the electrical terminal. The bore and inner housing sleeve are sized such that the inner housing sleeve is in an interference fit condition when received within the bore. The electrical connector assembly is assembled by a process including the step of inserting the inner housing sleeve within the bore of the outer connector housing and affixing the inner housing sleeve to the outer connector housing by welding the inner housing sleeve to the outer connector housing.

In one or more embodiments of the electrical connector assembly according to the previous paragraph, the welding may be performed by selectively melting a portion of the polymeric material of the inner housing sleeve and a portion of the polymeric material of the outer connector housing.

In one or more embodiments of the electrical connector assembly according to any one of the previous paragraphs, the welding may be performed by using a sonic welding process.

In one or more embodiments of the electrical connector assembly according to any one of the previous paragraphs, a curved first rib may extend radially from the inner housing sleeve.

In one or more embodiments of the electrical connector assembly according to any one of the previous paragraphs, the first rib may be sized such that the inner housing sleeve is in an interference fit condition with the bore when the inner housing sleeve is received within the bore and wherein the first rib is welded to the outer connector housing.

In one or more embodiments of the electrical connector assembly according to any one of the previous paragraphs, a curved second rib may extend radially from the inner housing sleeve and the second rib may be sized such that the second rib is in a interference fit condition when the inner housing sleeve is received within the bore.

In one or more embodiments of the electrical connector assembly according to any one of the previous paragraphs, the inner housing sleeve and the bore may be configured to allow the attachment portion to be arranged at any radial orientation relative to a longitudinal axis of the bore.

In one or more embodiments of the electrical connector assembly according to any one of the previous paragraphs, the connection portion may be angled perpendicularly relative to the attachment portion.

In one or more embodiments of the electrical connector assembly according to any one of the previous paragraphs, the outer connector housing and the inner housing sleeve are formed of the same, i.e., an identical, polymeric material.

In one or more embodiments of the electrical connector assembly according to any one of the previous paragraphs, the polymeric material forming the outer connector housing and the inner housing sleeve is 20% glass filled polybutylene terephthalate.

According to one or more aspects of the present disclosure, a method of assembling an electrical connector assembly is presented. The having an electrical terminal electrical connector assembly has a connection portion configured to interface with a corresponding mating electrical connector and an attachment portion configured to interface with an electrical cable, a cylindrical inner housing sleeve formed of a polymeric material in which the connection portion of the electrical terminal is disposed and an outer connector housing formed of a polymeric material having a smooth bore configured to receive the inner housing sleeve containing the electrical terminal. The connection portion is angled relative to the attachment portion. The bore and inner housing sleeve are sized such that the inner housing sleeve is in an interference fit condition when received within the bore. The method includes the steps of inserting the inner housing sleeve within the bore of the outer connector housing and affixing the inner housing sleeve to the outer connector housing by welding a portion of the inner housing sleeve to a portion of the outer connector housing.

In one or more embodiments of the method according to the previous paragraph, the method may further include the step of selectively melting a portion of the polymeric material of the inner housing sleeve and a portion of the polymeric material of the outer connector housing.

In one or more embodiments of the electrical connector assembly according to any one of the previous paragraphs, the welding is performed by using a sonic welding process.

In one or more embodiments of the electrical connector assembly according to any one of the previous paragraphs, a curved first rib may extend radially from the inner housing sleeve. The first rib may be sized such that the inner housing sleeve is in an interference fit condition with the bore when the inner housing sleeve is received within the bore. The method may further include the step of welding the first rib to the outer connector housing.

In one or more embodiments of the electrical connector assembly according to any one of the previous paragraphs, the inner housing sleeve may define a curved second rib radially extending from the inner housing sleeve. The second rib may be sized such that the second rib is in an interference fit condition when the inner housing sleeve is received within the bore.

In one or more embodiments of the electrical connector assembly according to any one of the previous paragraphs, the inner housing sleeve and the bore may be configured to allow the attachment portion to be arranged at any radial orientation relative to a longitudinal axis of the bore prior to the affixing step.

In one or more embodiments of the electrical connector assembly according to any one of the previous paragraphs, the connection portion may be angled perpendicularly relative to the attachment portion.

According to one or more aspects of the present disclosure, a coaxial connector assembly includes a coaxial terminal having a connection portion extending along a first axis and configured to interface with a corresponding mating coaxial connector and an attachment portion extending along a second axis and attached to a coaxial electrical cable. The first axis is arranged at a ninety-degree angle relative to the second axis. The coaxial connector assembly further includes a cylindrical inner housing sleeve formed of a polymeric material in which the connection portion of the coaxial terminal is disposed and an outer connector housing formed of a polymeric material having a bore extending along the first axis through the outer connector housing. A first side of the outer connector housing extends parallel to the first axis and a second side extending parallel to the first axis and is arranged generally perpendicular to the first side. The inner housing sleeve is fixed within the outer connector housing such that the second axis of the attachment portion is nonparallel to the first side of the outer connector housing and nonparallel to the second side of the outer connector housing.

In one or more embodiments of the coaxial connector assembly according to the previous paragraph, an inner surface of the bore may be smooth. The inner housing sleeve may be welded to the outer connector housing.

In one or more embodiments of the coaxial connector assembly according to any one of the previous paragraphs, the first rib may be sized such that the inner housing sleeve is in an interference fit condition with the bore when the inner housing sleeve is received within the bore and wherein the first rib is sonically welded to the outer connector housing.

DETAILED DESCRIPTION

This application is directed to an electrical connector The connector is designed so that a right-angled terminal and a wire cable attached to it can be arranged at any angle relative to an outer connector housing of the connector. This is accomplished with a smooth bore cavity in the outer housing that receives an inner housing sleeve holding the right-angled terminal. The inner housing sleeve is in an interference fit with the outer connector housing once it is inside the bore. After the inner housing sleeve is arranged in the bore to have the desired "clock position" of the right angled terminal relative to the outer connector housing, the inner housing sleeve is sonically welded to an inner wall of the bore though the outer connector housing to fix the "clock position" of the right angled terminal.

Figure 1:
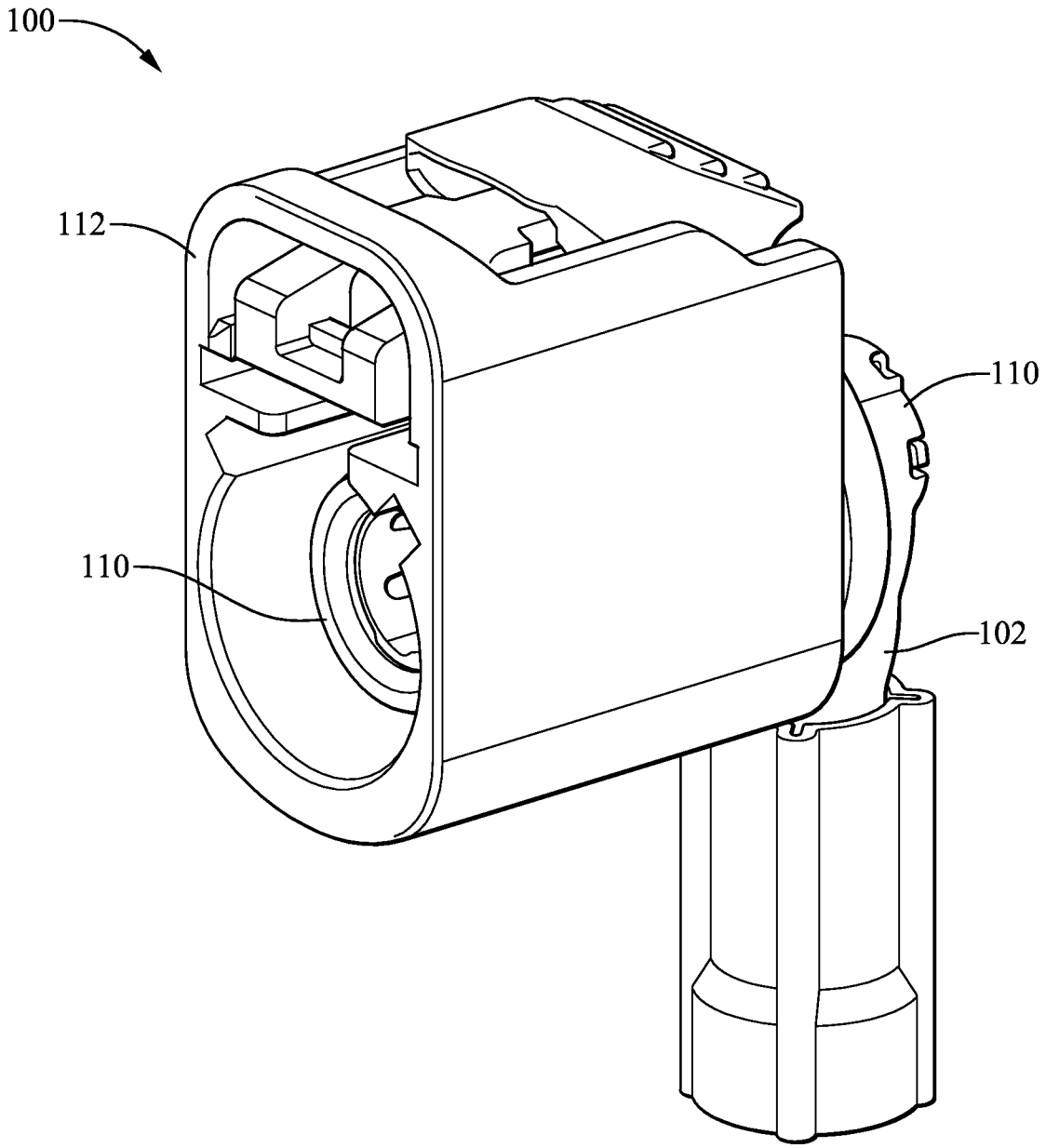
FIG. 1 is a perspective view of an electrical connector according to some embodiments.
Figure 2:
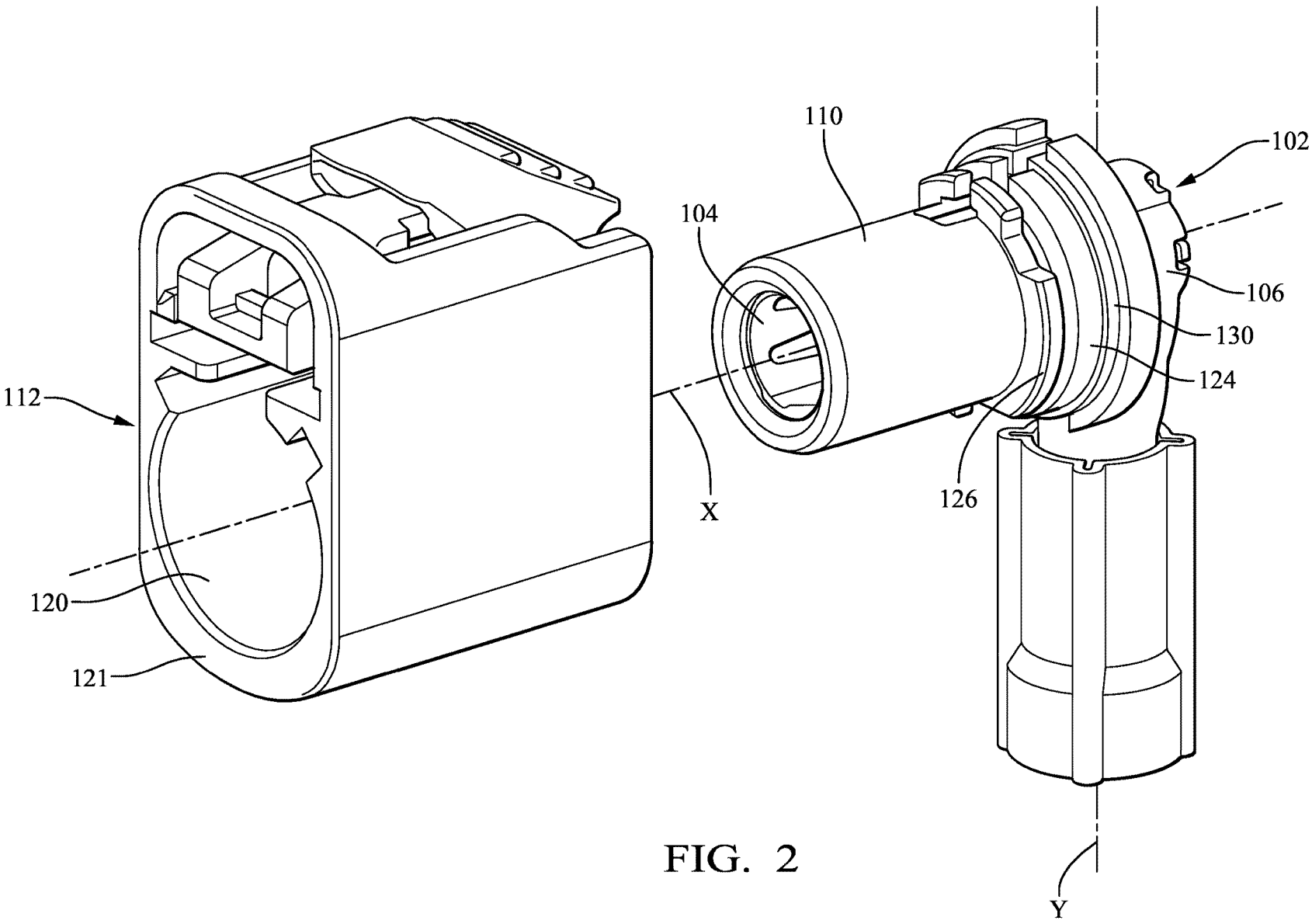
FIG. 2 is an exploded perspective view of the electrical connector of FIG. 1 according to some embodiments.

FIGS. 1 and 2 illustrate a non-limiting example of a right angled coaxial electrical connector assembly, hereinafter referred to as the assembly 100 conforming to the FAKRA standard. FAKRA is an abbreviation for the German term Fachnormenausschuss Kraftfahrzeugindustrie used by the Automotive Standards Committee in the German Institute for Standardization [Deutsches Institut für Normung (DIN)], representing international standardization interests in the automotive field. The FAKRA standard provides a system, based on keying and color coding, for proper connector attachment of coaxial electrical connectors. Like socket keys can only be connected to like plug keyways in FAKRA connectors. Secure positioning and locking of connector housings is facilitated by way of a FAKRA defined catch on the socket housing and a cooperating latch on the plug housing. The FAKRA standard is incorporated in United States Council for Automotive Research (USCAR) USCAR-18 standard.

The assembly 100 includes an electrical terminal 102 having a connection portion 104 extending along a first axis X that is configured to interface with a corresponding mating electrical connector (now shown) and an attachment portion 106 configured to interface with a coaxial electrical cable (not shown). In the illustrated example, the electrical terminal 102 is an outer shield terminal connected to the outer shield of the coaxial cable. The connection portion 104 extends along a second axis Y that is noncoaxial with the first axis X such that the connection portion 104 is angled relative to the attachment portion 106. In the illustrated embodiment, the attachment portion 106 is arranged generally perpendicular or at a right angle to the connection portion 104 of the electrical terminal 102. Alternative embodiments may be envisioned in which the attachment portion 106 and the cable is arranged at an angle between 0 and 90 degrees to the connection portion 104 of the electrical terminal 102.

The connection portion 104 of the electrical terminal 102 is secured within a cylindrical inner housing sleeve 110. The inner housing sleeve 110 is formed of an insulative polymeric material, such as 20% glass filled polybutylene terephthalate.

Figure 3B:
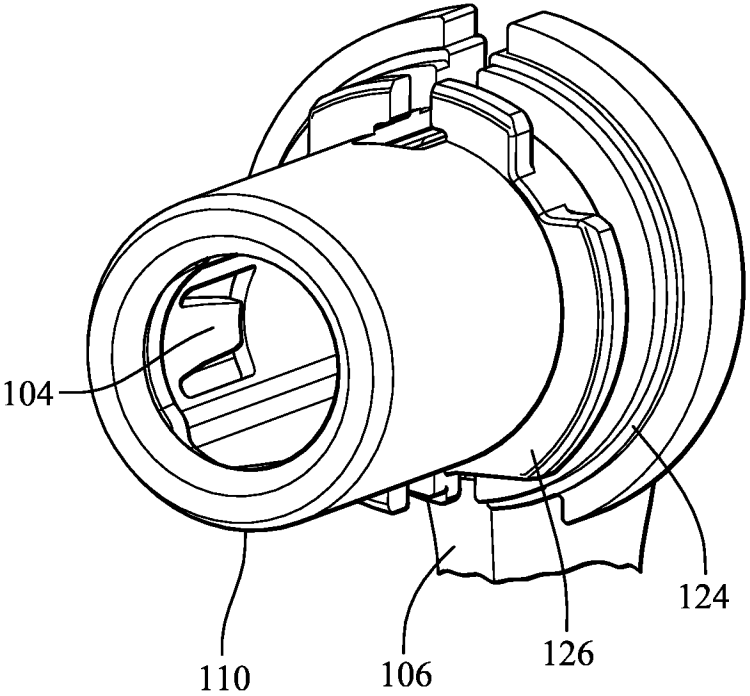
FIG. 3B is a front perspective view of an inner housing sleeve of the electrical connector of FIG. 1 according to some embodiments.
Figure 3A:
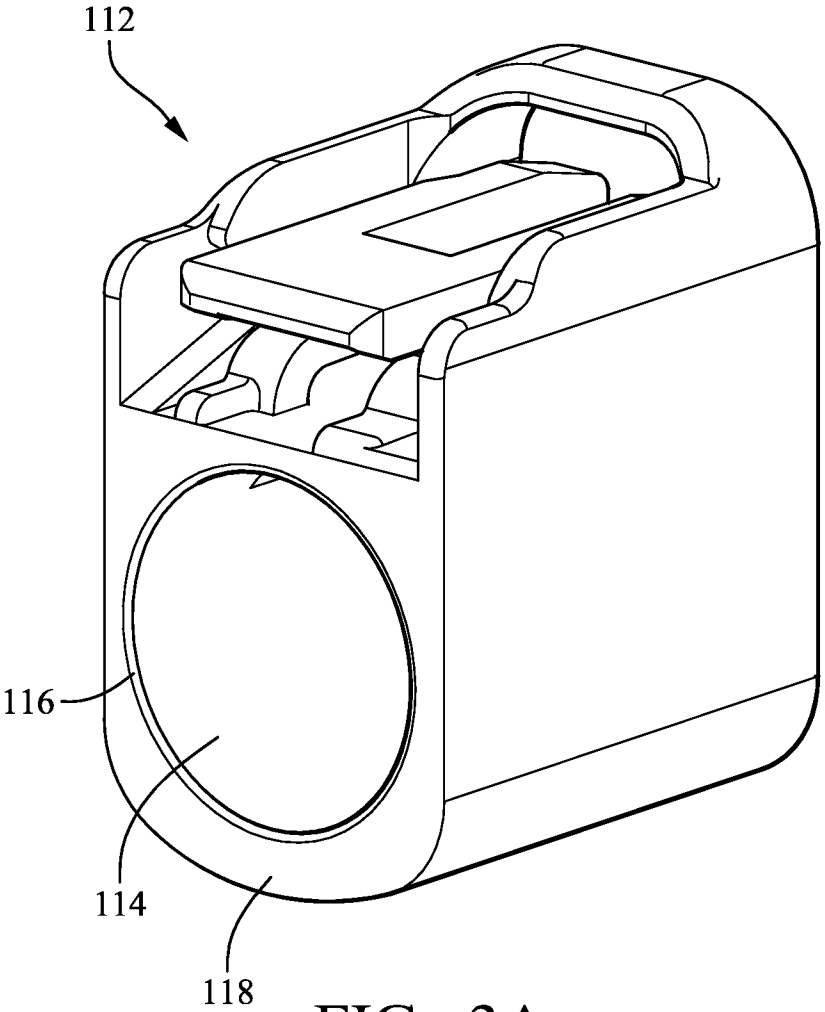
FIG. 3A is a rear perspective view of an outer connector housing of the electrical connector of FIG. 1 according to some embodiments.

The assembly 100 also includes an outer connector housing 112 having a smooth bore 114, shown in FIG. 3A, extending from an attachment aperture 116 in a rear surface 118 of the outer connector housing 112 to a connection aperture 120 in a front surface 122 of the outer connector housing 112. The smooth bore 114 is configured to receive the inner housing sleeve 110 containing the electrical terminal 102 though the attachment aperture 116. The rear surface 118 of the outer connector housing 112 is generally flat. The outer connector housing 112 is also formed of an insulative polymeric material, such as the same 20% glass filled polybutylene terephthalate material forming the inner housing sleeve 110. The smooth bore 114 and inner housing sleeve 110 are sized such that the inner housing sleeve 110 is in an interference fit condition when received within the smooth bore 114.

Figure 4A:
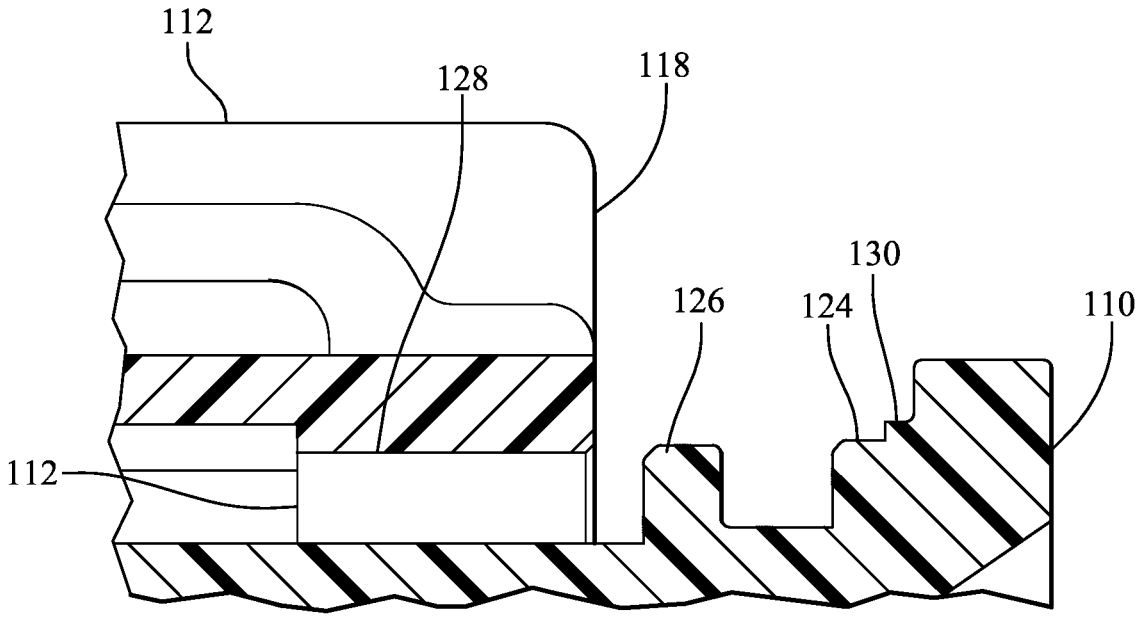
FIG. 4A is cross-section side view of the electrical connector of FIG. 1 prior to the insertion of the inner housing sleeve of FIG. 3B into the outer connector housing of FIG. 3A according to some embodiments.
Figure 4B:
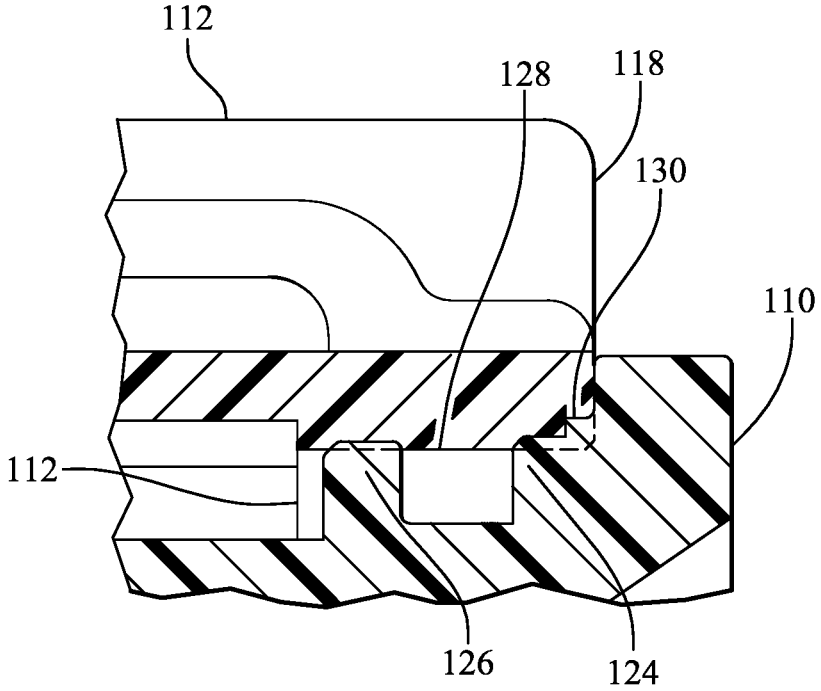
FIG. 4B is cross-section side view of the electrical connector of FIG. 1 after insertion of the inner housing sleeve of FIG. 3B into the outer connector housing of FIG. 3A according to some embodiments.

The inner housing sleeve 110 has concentric curved first and second ribs 124, 126, shown in FIGS. 3B and 4A, that extend radially from the inner housing sleeve 110. These first and second ribs 124, 126 are in an interference fit condition with the inner wall 128 of the smooth bore 114 when the inner housing sleeve 110 is inserted within the smooth bore 114, as shown in FIG. 4B.

Figure 5:
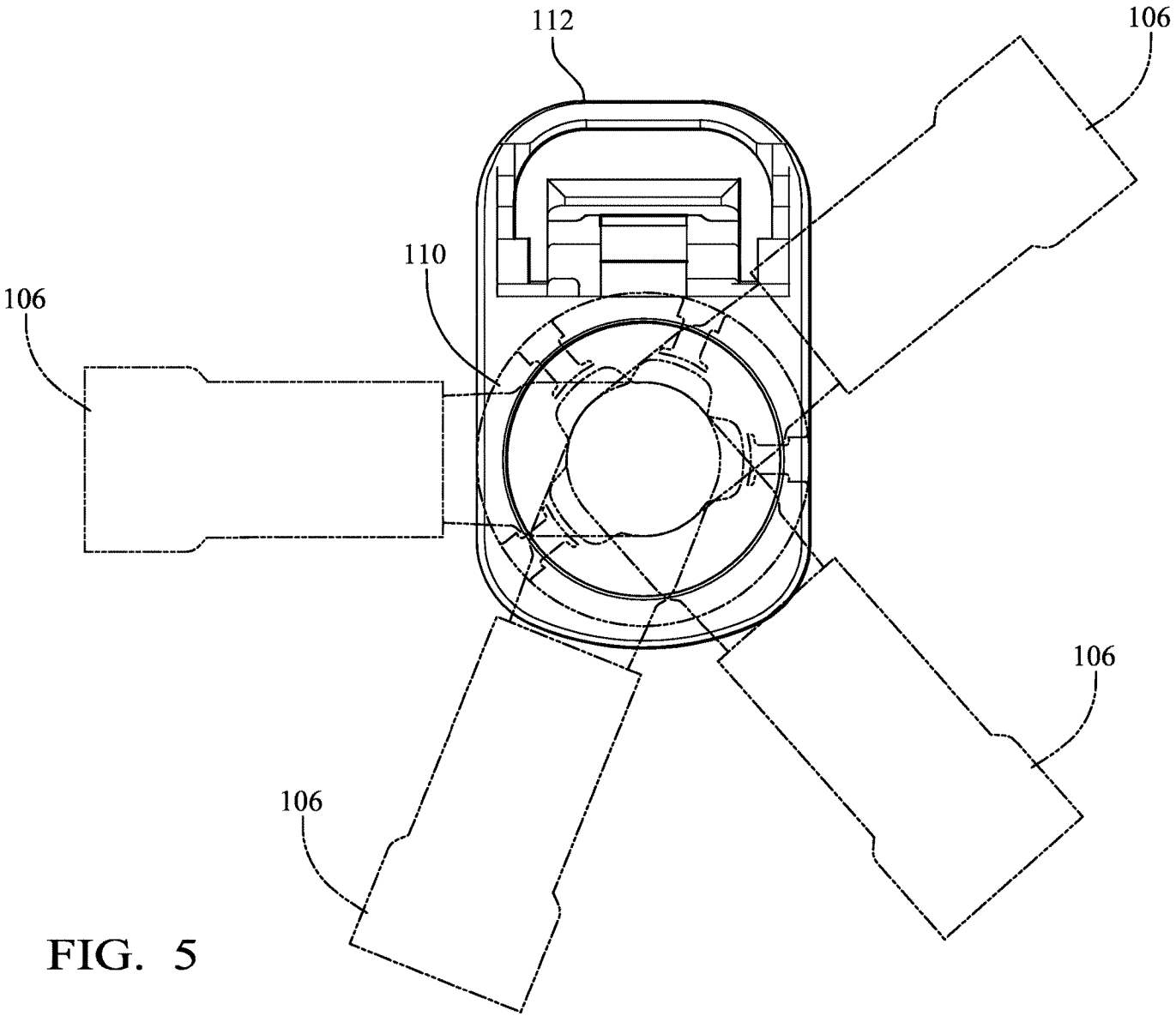
FIG. 5 is rear view of the electrical connector of FIG. 1 showing various possible "clock positions" of a terminal according to some embodiments.

The smooth bore 114 and the flat rear surface 118 of the outer connector housing 112 cooperate with the curved first and second ribs 124, 126 of the inner housing sleeve 110 to allow the attachment portion 106 of the electrical terminal 102 to be arranged at any radial angle or "clock position" relative the outer connector housing 112 as shown in FIG. 5.

Once the attachment portion 106 is arranged in the desired clock position, the inner housing sleeve 110 is affixed to the outer connector housing 112 by welding the inner housing sleeve 110 to the inner wall 128 of the smooth bore 114, thereby permanently arranging the attachment portion 106 of the electrical terminal 102 in the desired clock position. The rearmost first rib 124 defines a raised ridge 130 that extends across the first rib 124, as best shown in FIGS. 4A and 4B. It is this ridge 130 that primarily forms the weld between the inner housing sleeve 110 and the outer connector housing 112.

Figure 6:
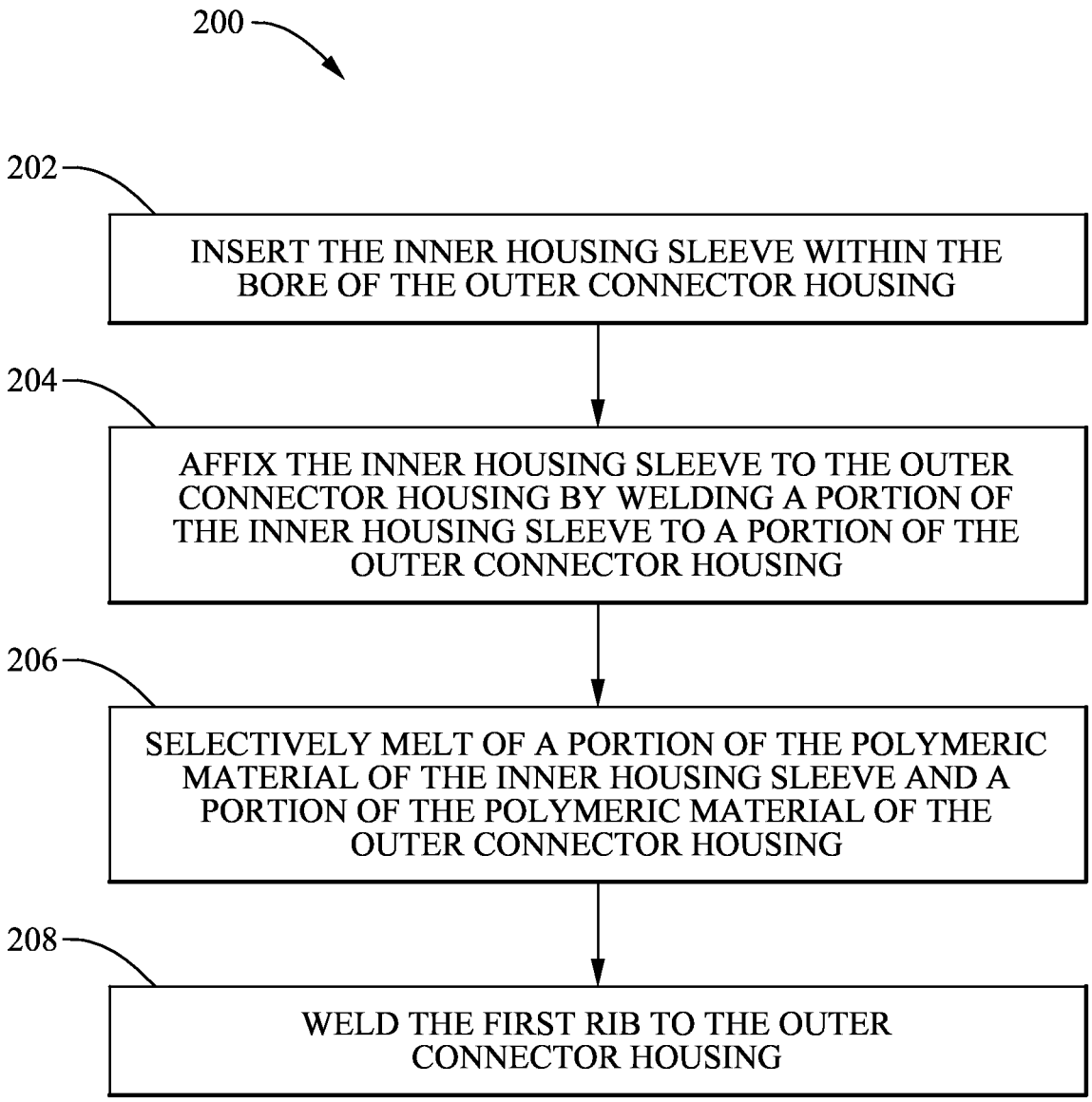
FIG. 6 is a flow chart of a process or method of forming the electrical connector assembly of FIG. 1

A method 200 of assembling the assembly 100 is shown in the diagram of FIG. 6. The various steps of the method 200 are outlined below:

STEP 202, INSERT THE INNER HOUSING SLEEVE WITHIN THE BORE OF THE OUTER CONNECTOR HOUSING, includes inserting the inner housing sleeve 110 within the smooth bore 114 of the outer connector housing 112;

STEP 204, AFFIX THE INNER HOUSING SLEEVE TO THE OUTER CONNECTOR HOUSING BY WELDING A PORTION OF THE INNER HOUSING SLEEVE TO A PORTION OF THE OUTER CONNECTOR HOUSING, includes affixing the inner housing sleeve 110 to the outer connector housing 112 by welding a portion of the inner housing sleeve 110 to a portion of the outer connector housing 112;

STEP 206, SELECTIVELY MELT OF A PORTION OF THE POLYMERIC MATERIAL OF THE INNER HOUSING SLEEVE AND A PORTION OF THE POLYMERIC MATERIAL OF THE OUTER CONNECTOR HOUSING, includes selectively melting a portion of the polymeric material of the inner housing sleeve 110 and a portion of the polymeric material of the outer connector housing 112, for example by using a sonic welding process; and STEP 208, WELD THE FIRST RIB TO THE OUTER CONNECTOR HOUSING, includes welding the first rib 124 to the outer connector housing 112.

While the exemplary embodiment is a coaxial electrical connector assembly, other connector assembly embodiments may be envisioned that are adapted for use with single conductor stranded or solid wire cables, fiber optic cables, pneumatic tubes, hydraulic tubes, or a hybrid connector assembly including two or more of the items listed above.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

The invention claimed is:

1. An electrical connector assembly, comprising:

an electrical terminal having a connection portion configured to interface with a corresponding mating electrical connector and an attachment portion configured to interface with an electrical cable, wherein the connection portion is angled relative to the attachment portion;

a cylindrical inner housing sleeve formed of a polymeric material in which the connection portion of the electrical terminal is disposed and having a curved first rib extending radially therefrom; and an outer connector housing formed of a polymeric material having a smooth bore configured to receive the inner housing sleeve containing the electrical terminal, wherein the bore and inner housing sleeve are sized such that the inner housing sleeve is in an interference fit condition when received within the bore, the electrical connector assembly being assembled by a process comprising:

inserting the inner housing sleeve within the bore of the outer connector housing, wherein the first rib is sized such that the inner housing sleeve is in an interference fit condition with an inner wall of the bore; and affixing the inner housing sleeve to the outer connector housing by welding the first rib to the inner wall of the bore.

2. The electrical connector assembly according to claim 1, wherein the welding is performed by selectively melting a portion of the polymeric material of the inner housing sleeve and a portion of the polymeric material of the outer connector housing.

3. The electrical connector assembly according to claim 1, wherein the welding is performed by using a sonic welding process.

4. The electrical connector assembly according to claim 1, wherein a curved second rib extends radially from the inner housing sleeve and wherein the second rib is sized such that the second rib is in an interference fit condition with the inner wall of the bore when the inner housing sleeve is received within the bore.

5. The electrical connector assembly according to claim 1, wherein the inner housing sleeve and the bore are configured to allow the attachment portion to be arranged at any radial orientation relative to a longitudinal axis of the bore.

6. The electrical connector assembly according to claim 1, wherein the connection portion is angled perpendicularly relative to the attachment portion.

7. The electrical connector assembly according to claim 1, wherein the outer connector housing and the inner housing sleeve are formed of an identical polymeric material.

8. The electrical connector assembly according to claim 7, wherein the polymeric material forming the outer connector housing and the inner housing sleeve is 20% glass filled polybutylene terephthalate.

9. A method of assembling an electrical connector assembly having an electrical terminal having a connection portion configured to interface with a corresponding mating electrical connector and an attachment portion configured to interface with an electrical cable, a cylindrical inner housing sleeve formed of a polymeric material in which the connection portion of the electrical terminal is disposed having a curved first rib extending radially therefrom and an outer connector housing formed of a polymeric material having a smooth bore configured to receive the inner housing sleeve containing the electrical terminal, wherein the connection portion is angled relative to the attachment portion and wherein the bore and the first rib are sized such that the first rib is in an interference fit condition with an inner wall of the bore when the inner housing sleeve is received within the bore, the method comprising:

inserting the inner housing sleeve within the bore of the outer connector housing; and affixing the inner housing sleeve to the outer connector housing by welding the first rib to the inner wall of the bore.

10. The method according to claim 9, further comprising:

selectively melting a portion of the polymeric material of the inner housing sleeve and a portion of the polymeric material of the outer connector housing.

11. The method according to claim 9, wherein the welding is performed by using a sonic welding process.

12. The method according to claim 9, wherein the inner housing sleeve defines a curved second rib radially extending from the inner housing sleeve and wherein the second rib is sized such that the second rib is in an interference fit condition when the inner housing sleeve is received within the bore.

13. The method according to claim 9, wherein the inner housing sleeve and the bore are configured to allow the attachment portion to be arranged at any radial orientation relative to a longitudinal axis of the bore prior to the affixing step.

14. The method according to claim 9, wherein the connection portion is angled perpendicularly relative to the attachment portion.

15. A coaxial connector assembly, comprising:

a coaxial terminal having a connection portion extending along a first axis and configured to interface with a corresponding mating coaxial connector and an attachment portion extending along a second axis and attached to a coaxial electrical cable, wherein the first axis is arranged at a ninety-degree angle relative to the second axis;

a cylindrical inner housing sleeve formed of a polymeric material in which the connection portion of the coaxial terminal is disposed and having a curved first rib extending radially therefrom; and an outer connector housing formed of a polymeric material having a bore extending along the first axis through the outer connector housing, a first side extending parallel to the first axis, and a second side extending parallel to the first axis and arranged generally perpendicular to the first side, wherein the inner housing sleeve is fixed within the outer connector housing such that the second axis of the attachment portion is nonparallel to the first side of the outer connector housing and nonparallel to the second side of the outer connector housing, wherein the first rib is sized such that the first rib is in an interference fit condition with an inner wall of the bore when the inner housing sleeve is received within the bore.

16. The coaxial connector assembly according to claim 15, wherein an inner surface of the bore is smooth and wherein the inner housing sleeve is welded to the outer connector housing.

17. The coaxial connector assembly according to claim 16, wherein the first rib is sonically welded to the outer connector housing.

18. The coaxial connector assembly according to claim 15, wherein a curved second rib extends radially from the inner housing sleeve and wherein the second rib is sized such that the second rib is in an interference fit condition with the inner wall of the bore when the inner housing sleeve is received within the bore.

* * * * *